US008867774B2

(12) United States Patent
Nokuo

(10) Patent No.: US 8,867,774 B2
(45) Date of Patent: Oct. 21, 2014

(54) PORTABLE AUDIO OUTPUT DEVICE

(75) Inventor: Taichi Nokuo, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 13/522,119

(22) PCT Filed: Jan. 18, 2011

(86) PCT No.: PCT/JP2011/050698
§ 371 (c)(1),
(2), (4) Date: Jul. 13, 2012

(87) PCT Pub. No.: WO2011/090009
PCT Pub. Date: Jul. 28, 2011

(65) Prior Publication Data

US 2012/0288133 A1 Nov. 15, 2012

(30) Foreign Application Priority Data

Jan. 22, 2010 (JP) ..... 2010-011991

(51) Int. Cl.
*H04R 25/00* (2006.01)
*H04R 1/10* (2006.01)

(52) U.S. Cl.
CPC ..... *H04R 1/105* (2013.01)
USPC ..... 381/383; 381/381; 381/378

(58) Field of Classification Search
USPC ..... 381/330, 328, 326, 370, 374–381, 383
See application file for complete search history.

(56) References Cited

U.S. PATENT DOCUMENTS

| | | | | | |
|---|---|---|---|---|---|
| 3,915,166 | A * | 10/1975 | McCrink | 128/866 |
| 4,289,938 | A * | 9/1981 | Zichy | 381/382 |
| 4,917,504 | A * | 4/1990 | Scott et al. | 381/381 |
| 5,927,659 | A * | 7/1999 | Yang | 248/58 |
| 6,427,018 | B1 * | 7/2002 | Keliiliki | 381/381 |
| 7,231,056 | B2 * | 6/2007 | Chen | 381/381 |
| 8,005,252 | B2 * | 8/2011 | Connors et al. | 381/381 |
| 8,019,111 | B2 * | 9/2011 | Soheili | 381/379 |
| 8,320,603 | B2 * | 11/2012 | Bass | 381/381 |
| 8,428,289 | B2 * | 4/2013 | Wengreen | 381/385 |
| 2003/0002706 | A1 * | 1/2003 | Keliiliki | 381/381 |
| 2005/0100185 | A1 * | 5/2005 | Connors et al. | 381/381 |
| 2005/0185814 | A1 * | 8/2005 | Chen | 381/381 |
| 2008/0298626 | A1 * | 12/2008 | Dean | 381/381 |
| 2008/0310666 | A1 * | 12/2008 | Wengreen | 381/381 |

(Continued)

FOREIGN PATENT DOCUMENTS

| | | | |
|---|---|---|---|
| JP | 58-136199 | A | 8/1983 |
| JP | 63-040091 | U | 3/1988 |

(Continued)

*Primary Examiner* — Davetta W Goins
*Assistant Examiner* — Phylesha Dabney
(74) *Attorney, Agent, or Firm* — Sony Corporation

(57) ABSTRACT

There is provided a portable audio output device that can be stably hooked over a user's external ear. A cord 2 is curved so as to be hooked over a user's external ear A. A speaker unit 10 has a holding unit 13 that holds the cord 2. The holding unit 13 holds the cord 2 in a position on the cord 2 away from an end 2*a* such that the cord 2 is curved between the end 2*a* and a portion thereof held by the holding unit 13. The holding unit 13 is configured such that the cord 2 can move relative to the holding unit 13.

15 Claims, 11 Drawing Sheets

(56) References Cited

U.S. PATENT DOCUMENTS

| | | | | |
|---|---|---|---|---|
| 2010/0111347 | A1* | 5/2010 | Soheili | 381/379 |
| 2010/0124349 | A1* | 5/2010 | Bass | 381/379 |
| 2011/0164778 | A1* | 7/2011 | Wengreen | 381/381 |

FOREIGN PATENT DOCUMENTS

| | | | |
|---|---|---|---|
| JP | 2004-356818 | A | 12/2004 |
| JP | 2009-055122 | A | 3/2009 |
| JP | 2009-212947 | A | 9/2009 |

* cited by examiner

PORTABLE AUDIO OUTPUT DEVICE

TECHNICAL FIELD

The present invention relates to portable audio output devices used by being placed on a user's ear, such as an earphone and a headset, and more particularly to techniques for improving the stability of placement on a user's ear.

BACKGROUND ART

Conventionally, a portable audio output device which is placed on a user's ear such as an earphone is used. Conventional portable audio output devices include one having a hook-shaped hanger unit which is hooked over a user's external ear and one having a frame-shaped hanger unit surrounding an external ear (see, for example, Patent Document 1). In the conventional portable audio output devices, the hanger units are formed of a resin such as a plastic.

CITATION LIST

Patent Document

Patent Document 1: Japanese Patent Application Laid-Open No. 2009-55122

SUMMARY OF THE INVENTION

Problems to be Solved by the Invention

In the conventional portable audio output devices, the hanger units are too large or too small, depending on the size of the user's external ear and thus there is a case in which the hanger units are not stably hooked over the user's external ear.

The present invention has been made in view of the above-described problem and an object of the present invention is to provide a portable audio output device that can be stably hooked over a user's external ear.

Solutions to Problems

To solve the above-described problem, a portable audio output device according to the present invention is a portable audio output device to be placed on a user's ear and includes: a speaker unit including a speaker; and a cord having one end connected to the speaker unit. The cord is curved so as to be hooked over a user's external ear. The speaker unit is provided with a holding unit that holds the cord. The holding unit holds the cord in a position on the cord away from the one end of the cord such that the cord is curved between the one end and a portion thereof held by the holding unit. The holding unit is configured such that the cord can move relative to the holding unit.

According to the present invention, by adjusting a position in which the holding unit holds the cord, a portion of the cord hooked over the external ear can be changed in length to fit the size of the user's external ear. Hence, the portable audio output device can be stably hooked over the ear.

In one aspect of the present invention, the cord may be curved so as to be hooked over the user's external ear and then may extend downward, and the holding unit may hold a portion of the cord extending downward. According to the aspect, the length of the curved portion of the cord can be adjusted by moving the cord downward relative to the holding unit.

In one aspect of the present invention, a hole is provided in the holding unit and the cord passes through the hole in the holding unit. With this configuration, the cord can be allowed to smoothly slide relative to the holding unit.

In one aspect of the present invention, the speaker unit has a housing that accommodates the speaker, and the holding unit extends from the housing and holds the cord by an end thereof. According to the aspect, the cord can be held in a position away from the user's ear and thus unwanted interference between the ear and the cord can be suppressed.

In one aspect of the present invention, the speaker unit may have a connecting unit formed so as to extend from a housing that accommodates the speaker, and the one end of the cord may be connected to an upper end of the connecting unit. According to the aspect, since the cord can be connected to the speaker unit in a position away from the user's ear, unwanted interference between the user's ear and the cord can be suppressed.

In addition, in this aspect, the connecting unit may extend from the housing and may be curved in an extending direction on a side of the one end of the cord. With this configuration, when the cord is pulled, the load applied to the one end of the cord connected to the connecting unit can be reduced.

In one aspect of the present invention, the speaker unit may have a connecting unit to which the one end of the cord is connected, the connecting unit being located before the speaker, the cord may extend upward from the connecting unit and then may be curved downward, and the holding unit may hold the cord in a position below the speaker. According to the aspect, a portion of the cord between the connecting unit and the holding unit can be made to have an arc shape surrounding the user's external ear. Then, in the aspect, since the one-end and other-end sides of the arc-shaped portion are respectively supported by the connecting unit and the holding unit, by moving the cord relative to the holding unit, the length of the arc-shaped portion can be shortened with the shape of the cord maintained.

In one aspect of the present invention, the speaker unit may have a housing that accommodates the speaker, and the holding unit may diagonally extend from the housing in a radial direction of the speaker and in a direction in which the speaker faces. According to the aspect, when the portable audio output device is used, the holding unit can hold the cord in a position close to the user's head. Hence, the position of the curved portion of the cord can be brought close to the user's head. As a result, the cord is more stably hooked over the user's external ear.

In one aspect of the present invention, the speaker unit may have a connecting unit to which the one end of the cord is connected, and the connecting unit may be faulted of an elastic material. According to the aspect, when the cord is pulled, the connecting unit can be deformed. As a result, the load applied to the end of the cord can be reduced.

In one aspect of the present invention, the holding unit may be formed of an elastic material. According to the aspect, when an external force acts on a portion held by the holding unit, the holding unit can be deformed. As a result, a state in which the holding unit holds the cord is easily maintained.

In one aspect of the present invention, the speaker unit may have a housing that accommodates the speaker, and the housing may be provided such that the speaker can face in two directions opposite to each other. According to the aspect, the portable audio output device can be placed on both the user's right and left ears.

In this aspect, the speaker unit may have a supporting unit that rotatably supports the housing. By doing so, the orientation of the speaker can be changed by a simple operation.

In this aspect, the speaker unit may have a supporting unit that supports the housing. Then, the holding unit may be provided to be movable between a first position in which the cord is held in a position shifted in one of the two directions from a position of the supporting unit and a second position in which the cord is held in a position shifted in another direction from the position of the supporting unit. By doing so, even when the portable audio output device is placed on either of the user's ears, the position of the curved portion of the cord can be brought close to the user's head, enabling to stably hook the cord over the user's external ear.

MODE FOR CARRYING OUT THE INVENTION

Figure 1:
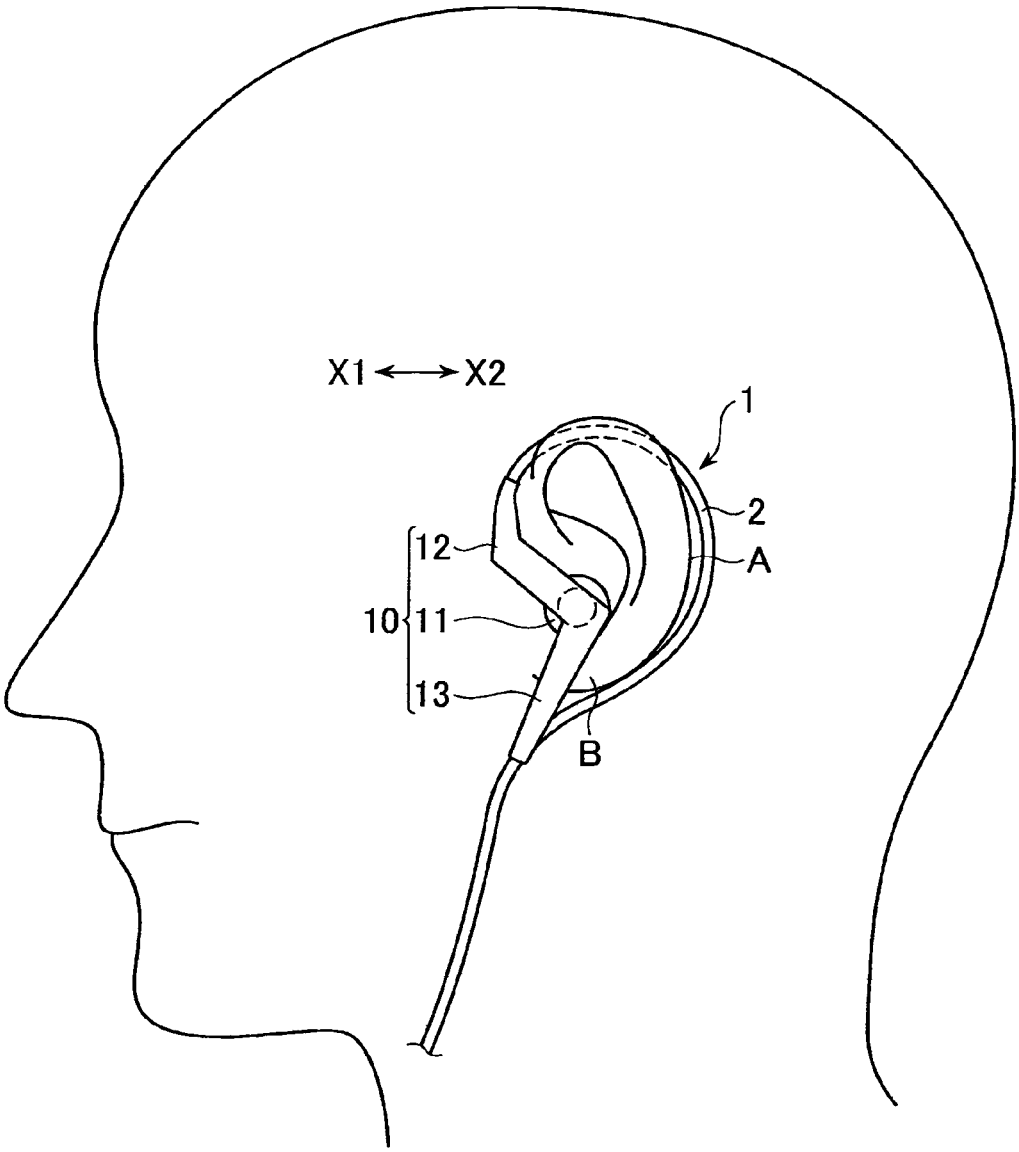
FIG. 1 is a side view of an earphone according to an embodiment of the present invention. The drawing shows an earphone placed on a user's ear.
Figure 2:
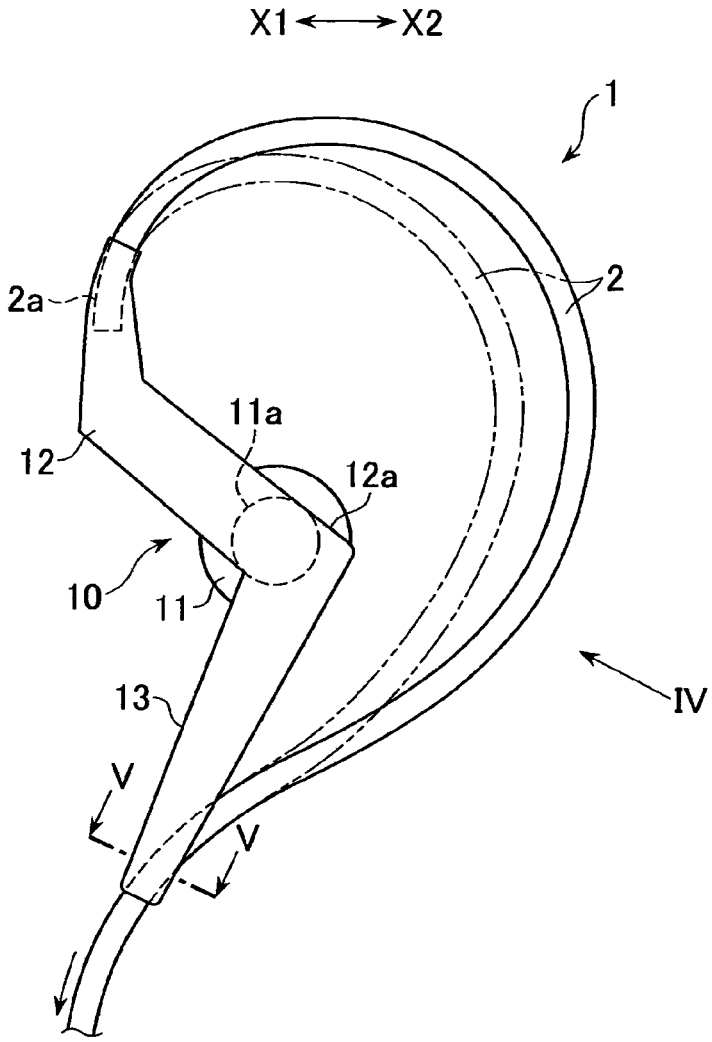
FIG. 2 is a side view of the earphone.
Figure 3:
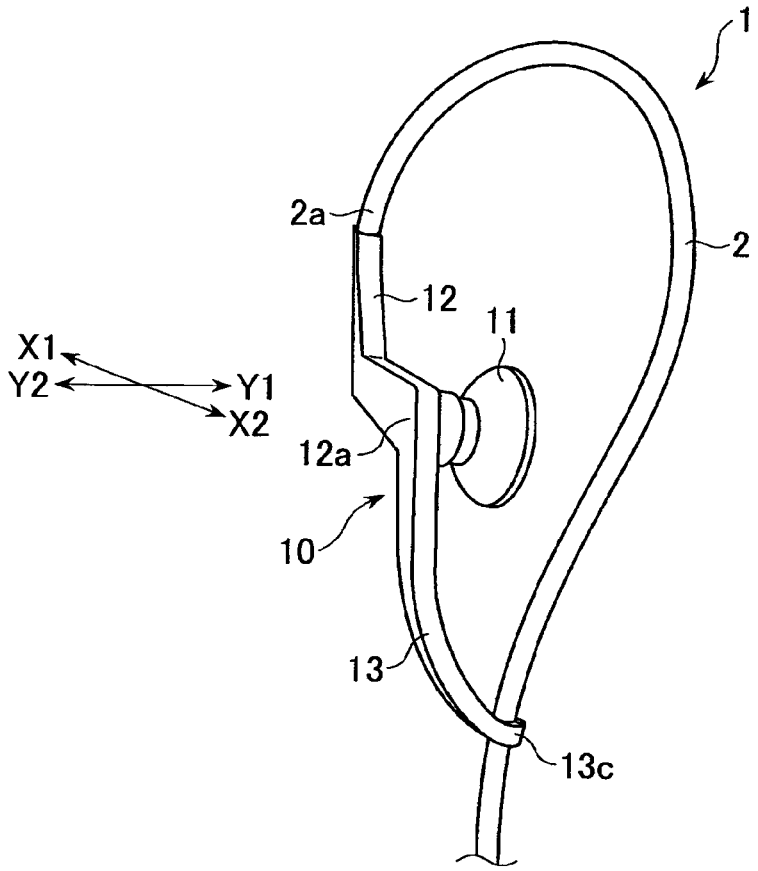
FIG. 3 is a perspective view of the earphone as viewed from the diagonal rear thereof.
Figure 4:
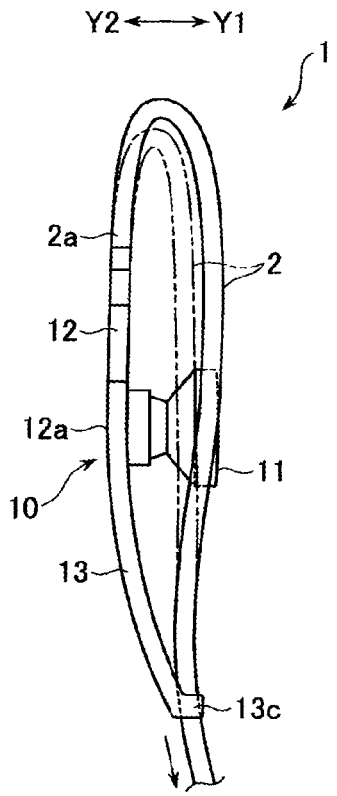
FIG. 4 is a view of the earphone as viewed from the direction of arrow IV shown in FIG. 2.
Figure 5:
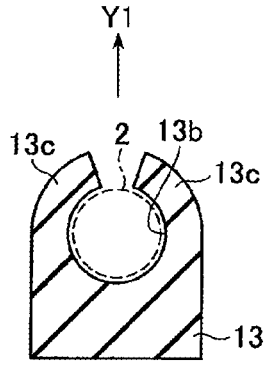
FIG. 5 is a cross-sectional view taken along line V-V shown in FIG. 2.

One embodiment of the present invention will be described below with reference to the drawings. First, an earphone 1 which is an example of a portable audio output device according to an embodiment of the present invention will be described. FIGS. 1 and 2 are side views of the earphone 1. FIG. 1 shows the earphone 1 placed on a user's ear. FIG. 3 is a perspective view of the earphone 1 as viewed from the diagonal rear thereof. FIG. 4 is a view of the earphone 1 as viewed from the direction of arrow IV shown in FIG. 2. FIG. 5 is a cross-sectional view taken along line V-V shown in FIG. 2. Note that although FIGS. 1 to 4 show a speaker unit 10 which is placed on a user's left ear, the earphone 1 also includes a speaker unit which is placed on a user's right ear. Note also that, in the following description, a direction in which a user wearing the earphone 1 faces is the front of the earphone 1 (a direction indicated by X1 in FIG. 1 or 2). Note also that the left and right directions of the head of the user wearing the earphone 1 are the left and right directions of the earphone 1 (directions indicated by Y1-Y2 in FIG. 4).

As shown in FIGS. 1 to 3, the earphone 1 includes: the speaker unit 10 including a speaker 11*a*; and a cord 2 connected to the speaker unit 10. In addition, as will be described later, the speaker unit 10 has a holding arm (holding unit) 13 that holds the cord 2. The holding arm 13 holds the cord 2 in a position on the cord 2 away from an end 2*a* such that the cord 2 is curved between the end 2*a* thereof and a portion thereof held by the holding arm 13. The speaker unit 10 further has a housing 11 that accommodates the speaker 11*a*. The earphone 1 is a so-called inner ear type earphone, and the housing 11 is inserted in a user's ear canal when the earphone 1 is used. In addition, the speaker unit 10 in this example has a connecting arm (connecting unit) 12 to which the cord 2 is connected.

As shown in FIG. 2, the connecting arm 12 is provided so as to extend from the housing 11 in the radial direction of the speaker 11*a*. Here, the connecting arm 12 extends from the housing 11 frontward (in a direction perpendicular to both the direction in which the speaker 11*a* outputs audio and the up and down directions). Specifically, the housing 11 is mounted on a base 12*a* of the connecting arm 12, and the connecting arm 12 extends frontward from the base 12*a* (see FIG. 3). The housing 11 is mounted on the base 12*a* and projects in one of the left and right directions (here, the right direction) from a side of the base 12*a*. The speaker 11*a* is disposed in the housing 11 so as to face in the above-described one direction.

The cord 2 is connected to the speaker unit 10 more frontward than the speaker 11*a*. In this example, the end 2*a* of the cord 2 is connected to an upper end of the connecting arm 12. The upper end side of the connecting arm 12 bends upward, and the cord 2 extends upward from the connecting arm 12. In other words, the end 2*a* of the cord 2 extends in a direction along the extending direction on the upper end side of the connecting arm 12. The connecting arm 12 gets thinner as it goes to the upper end. Note that the upper end side of the connecting arm 12 may be curved upward. In other words, the connecting arm 12 may be curved such that the upper end side thereof extends in a direction along the extending direction on the side of the end 2*a* of the cord 2.

The cord 2 has flexibility and is curved so as to be hooked over a user's external ear A. In this example, the cord 2 extends upward and diagonally rearward from the end 2*a* connected to the connecting arm 12 and is curved downward. Then, the cord 2 further extends downward. The curved portion of the cord 2 has an arc shape extending on the upper and rear sides of the user's external ear A. In addition, in this example, the cord 2 further extends within the connecting arm 12 toward the speaker 11*a*, and a wire of the cord 2 is electrically connected to the speaker 11*a*. As will be described later, the connecting arm 12 is formed of a material having higher stiffness than the cord 2. The connecting arm 12 controls deformation of a portion of the cord 2 formed in the connecting arm 12.

As described above, the speaker unit 10 has the holding arm 13 that holds the cord 2. The holding arm 13 holds the cord 2 in a position on the cord 2 away from the end 2*a* such that the cord 2 is curved between the end 2*a* and a portion thereof held by the holding arm 13. In this example, the end 2*a* of the cord 2 is located more frontward than the speaker 11*a*. On the other hand, the holding arm 13 holds the cord 2 in a position below the speaker 11*a*. Then, a portion of the cord 2 between the end 2*a* and a portion thereof held by the holding arm 13 has a roughly arc shape.

As shown in FIG. 2, the holding arm 13 is provided so as to extend from the housing 11 in the radial direction of the speaker 11*a*. In this example, the holding arm 13 extends downward from the housing 11. More specifically, the holding arm 13 extends downward from the base 12*a* of the connecting arm 12 on which the housing 11 is mounted. Hence, the extending direction of the holding arm 13 is roughly perpendicular to the extending direction of the connecting arm 12 (here, the front), and the connecting arm 12 and the holding arm 13 as a whole are formed in a substantially L-shape. In addition, the holding arm 13 extends downward from the housing 11 and thus is located outside a user's earlobe B when the earphone 1 is used (see FIG. 1). Note that although in this example the angle between the connecting arm 12 and the holding arm 13 is roughly perpendicular, the angle between the connecting arm 12 and the holding arm 13 may be an obtuse or acute angle.

The holding arm 13 extends downward from the housing 11 and holds the cord 2 by a lower end thereof. As described above, the cord 2 is curved so as to be hooked over the user's external ear A and then extends downward. The lower end of the holding arm 13 holds a portion of the cord 2 extending downward. Then, a portion of the cord 2 between the lower end of the holding arm 13 and the upper end of the connecting arm 12 is curved in an arc shape. In other words, one end (i.e., the end 2*a*) and the other end (a portion held by the holding arm 13) of the arc-shaped portion of the cord 2 are respectively connected to the upper end of the connecting arm 12 and the lower end of the holding arm 13. Hence, the arc-shaped portion of the cord 2, the connecting arm 12, and the holding arm 13 as a whole have a closed shape. In this example, the connecting arm 12 has a rod shape extending frontward from the base 12*a* of the connecting arm 12, and the holding arm 13 has a rod shape extending downward from the base 12*a* of the connecting arm 12. Hence, the connecting arm 12, the holding arm 13, and the arc-shaped portion of the cord 2 as a whole are formed in a closed frame shape.

The holding arm 13 is configured such that the cord 2 can move relative to the holding arm 13. Specifically, a position on the cord 2 in which the holding arm 13 holds the cord 2 can be adjusted by the cord 2 moving relative to the holding arm 13. In this example, as shown in FIG. 5, provided in the lower end of the holding arm 13 is a hole 13*b* that passes through the lower end in the up and down directions. The inner diameter of the hole 13*b* corresponds to the outer diameter of the cord 2 and the cord 2 extends downward, passing through the hole 13*b*. Hence, the cord 2 is slidable in the up and down directions relative to the lower end of the holding arm 13. In this example, formed at the lower end of the holding arm 13 is a pair of projections 13*c* projecting in a direction in which the speaker 11*a* faces (a direction in which the speaker 11*a* outputs audio; hereinafter, a speaker-directed direction, in this example, the right direction (a direction indicated by Y1 in FIG. 5)). The hole 13*b* is provided between the projections 13*c*, and the projections 13*c* catch the cord 2. Note that, as shown in FIG. 5, tips of the projections 13*c* are away from each other. Hence, the cord 2 can be removed from the holding arm 13.

As shown in FIG. 4, the holding arm 13 diagonally extends downward and in the speaker-directed direction. Hence, the position of the lower end of the holding arm 13 in the left and right directions is shifted in the speaker-directed direction from the position of the connecting arm 12. With this configuration, when the earphone 1 is placed on the ear, the cord 2 is held by the holding arm 13 in a position near the user's head. As a result, a portion of the cord 2 hooked over the external ear A (i.e., the curved portion) comes close to the user's head and the cord 2 is stably hooked over the user's external ear A. In addition, a clearance is secured between the portion of the cord 2 hooked over the external ear A and the holding arm 13. Thus, when the earphone 1 is placed on the ear, the user's earlobe B can be located in the clearance. Therefore, interference between the cord 2 and the user's earlobe B can be suppressed. Note that, in this example, the holding arm 13 extends downward and is gently curved in the speaker-directed direction.

As described above, the cord 2 has flexibility. Hence, when the cord 2 is pulled downward by the user and thereby moves downward relative to the holding arm 13, as shown by a dash-double-dotted line in FIG. 2, the curved portion of the cord 2 is shortened. As a result, the size of the curved portion of the cord 2 becomes one that fits the size of the user's external ear A, stabilizing placement of the earphone 1.

In addition, as shown in FIG. 4, when the cord 2 moves downward relative to the holding arm 13, the length of the curved portion of the cord 2 is shortened and thus the spacing between the curved portion and the arms 12 and 13 is narrowed. As a result, the user's external ear A is sandwiched between the cord 2 and the housing 11 and thus the earphone 1 is stably placed on the user's ear.

The holding arm 13 and the connecting arm 12 are formed of a material having higher stiffness than the cord 2. In this example, the holding arm 13 and the connecting arm 12 are integrally formed of an elastic material having higher stiffness than the cord 2. Specifically, the holding arm 13 and the connecting arm 12 are formed of an elastomer and a core that suppresses deformation of the elastomer. As a result, when the cord 2 is pulled downward, the connecting arm 12 bends slightly upward and thus the load applied to the cord 2 can be reduced. In addition, when an external force acts on the portion of the cord 2 held by the holding arm 13, the holding arm 13 deforms and thus the cord 2 can be suppressed from coming off the holding arm 13. Note that a core may be provided in a portion ranging from the base 12*a* of the connecting arm 12 to a midway position of the connecting arm 12 and such a core may not be provided on the upper end side of the connecting arm 12. Likewise, a core may be provided in a portion ranging from the base 12*a* of the connecting arm 12 to a midway position of the holding arm 13 and such a core may not be provided on the lower end side of the holding aim 13. Note that the housing 11 is formed of a resin, e.g., a plastic, and is mounted on the arms 12 and 13.

The holding arm 13 and the connecting arm 12 may be formed of a resin such as a plastic. In this case, the housing 11 and the connecting arm 12 may be integrally formed, and the holding arm 13 may be mounted on the connecting arm 12 or the housing 11. Alternatively, the holding aim 13 and the housing 11 may be integrally formed, and the connecting arm 12 may be mounted on the holding arm 13 or the housing 11.

As described above, in the earphone 1, the cord 2 is curved so as to be hooked over the user's external ear A. In addition, the speaker unit 10 has the holding arm 13 that holds the cord 2. The holding arm 13 holds the cord 2 in a position on the cord 2 away from the end 2*a* such that the cord 2 is curved between the end 2*a* and a portion thereof held by the holding arm 13. In addition, the holding arm 13 is configured such that the cord 2 can move relative to the holding arm 13. Hence, a position in which the holding arm 13 holds the cord 2 can be adjusted and thus the length of a portion of the cord 2 hooked over the external ear A can be changed. As a result, the earphone 1 can be stably hooked over the user's ear, irrespective of the size of the user's external ear A.

Note that the present invention is not limited to the above-described earphone 1 and various changes may be made thereto. For example, in the above description, the earphone 1 is provided with the connecting arm 12 in addition to the holding arm 13. However, the present invention is not limited to an earphone provided with the connecting arm 12. In such an earphone, an end 2*a* of a cord 2 may be directly connected to a housing 11 and the cord 2 may extend frontward from the housing 11 and may be curved upward.

In addition, the holding arm 13 holds the cord 2 in a position below the speaker 11*a*. However, the holding arm 13 may be formed to extend frontward and hold the cord 2 in a position before the speaker 11*a*. In this case, the cord 2 may be formed in a ring shape surrounding the user's ear. In addition, the connecting arm 12 is connected to the end 2*a* of the cord 2 in a position before the speaker 11*a*. However, the connecting arm 12 may be connected to the end 2*a* of the cord 2 in a position below the speaker 11*a*. In this case, too, the cord 2 may be formed in a ring shape surrounding the user's ear.

In addition, in the above description, the holding arm 13 has the pair of projections 13*c* and the cord 2 is allowed to pass through the hole 13*b* provided between the projections 13*c*. However, the lower end of the holding arm 13 may be formed in a tubular shape and the cord 2 may be allowed to pass through the tubular-shaped lower end.

Figure 6:
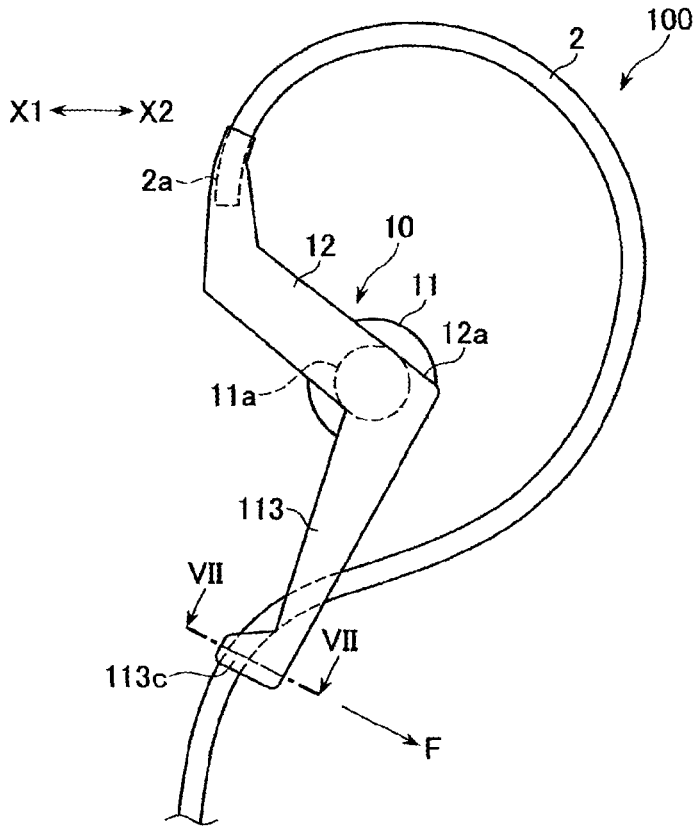
FIG. 6 is a side view of an earphone according to another embodiment of the present invention.
Figure 7:
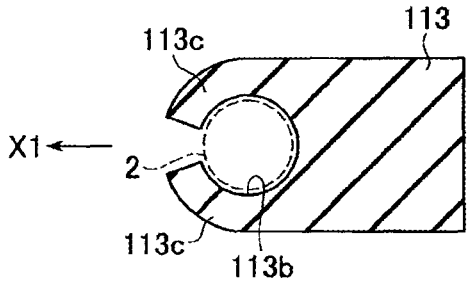
FIG. 7 is a cross-sectional view taken along line VII-VII shown in FIG. 6.

In addition, the projections 13*c* included in the holding arm 13 project in the speaker-directed direction from the lower end of the holding arm 13. However, the projections 13*c* may project frontward from the lower end of the holding arm 13. FIGS. 6 and 7 are diagrams showing an earphone 100 according to this embodiment. FIG. 6 is a side view of the earphone 100 and FIG. 7 is a cross-sectional view taken along line VII-VII shown in FIG. 6. In these drawings, the same parts as those described so far are denoted by the same reference characters.

As shown in FIG. 6, the earphone 100 has a holding arm 113. A pair of projections 113*c* projecting frontward is formed at a lower end of the holding arm 113. A hole 113*b* is provided between the projections 113*c* and a cord 2 extends downward, passing through the hole 113*b*. With this configuration, when the user pulls the cord 2, the cord 2 can be suppressed from coming off the holding arm 113. That is, since the holding arm 113 holds a portion of the cord 2 extending diagonally frontward, when the user pulls the cord 2 downward, force that presses the lower end of the holding arm 113 rearward (F in FIG. 6) acts on the lower end. In the earphone 1, since the projections 13*c* project in the speaker-directed direction from the lower end of the holding arm 13, the force F acts on one projection 13*c* and thus there is a possibility that the one projection 13*c* may deform. In the earphone 100, since the projections 113*c* project frontward from the lower end of the holding arm 113, the force F acts on the lower end of the holding arm 113 and thus deformation of the projections 113*c* is suppressed. As a result, a state in which the cord 2 is held by the holding arm 113 is easily maintained.

Figure 8:
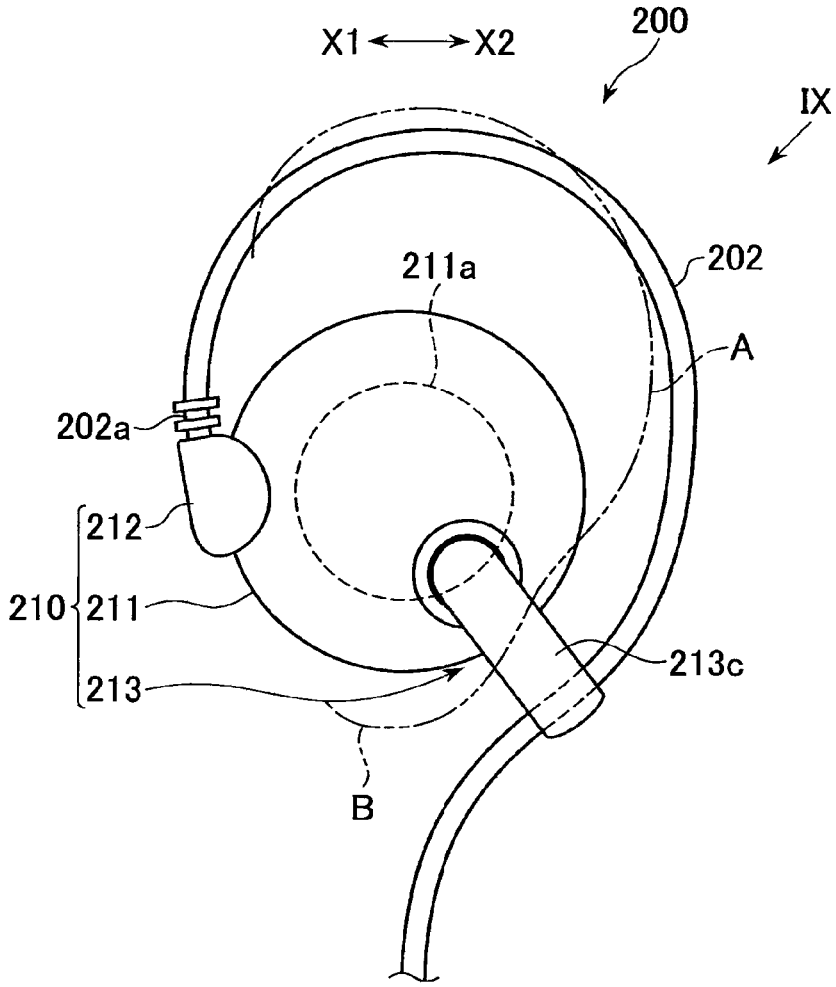
FIG. 8 is a side view of an earphone according to still another embodiment of the present invention.
Figure 9:
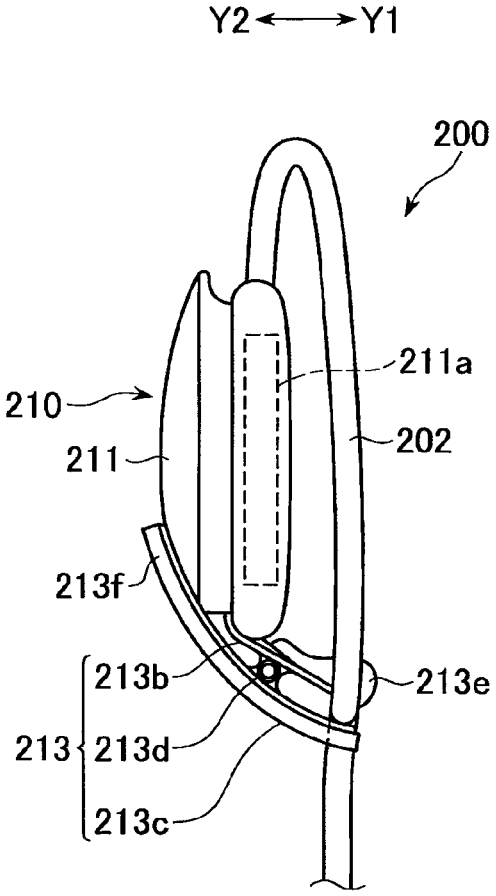
FIG. 9 is a view of the earphone of FIG. 8 as viewed from the direction of arrow IX shown in FIG. 8.

In addition, in the earphone 1, the cord 2 passes through the hole 13*b* provided in the lower end of the holding arm 13, by which the cord 2 can move relative to the holding arm 13. However, the speaker unit 10 may be provided with a clip-like holding unit that holds the cord 2, instead of such a holding unit 13 provided with the hole 13*b*. In this case, too, the clip-like holding unit opens to release the cord 2 therefrom, by which the cord 2 can smoothly move relative to the holding unit. FIGS. 8 and 9 are diagrams showing an earphone 200 according to this embodiment. FIG. 8 is a side view of the earphone 200 and FIG. 9 is a view of the earphone 200 as viewed from arrow IX shown in FIG. 8.

As shown in FIG. 8, the earphone 200 has a speaker 211*a* having a larger diameter than the speaker 11*a* included in the earphone 1. A housing 211 that accommodates the speaker 211*a* is disposed so as to face the ear at the outer portion of the user's ear canal when the earphone 200 is used.

A speaker unit 210 has a connecting unit 212 to which an end 202*a* of a cord 202 is connected. The connecting unit 212 is provided at an outer edge of the housing 211 and is located more frontward than the speaker 211*a*. Hence, the end 202*a* of the cord 202 is connected to the speaker unit 210 on the front side of the speaker 211*a*. In the earphone 200, too, the cord 202 is curved so as to be hooked over the user's external ear A. Specifically, the cord 202 extends upward from the end 202*a* and then is curved rearward (a direction indicated by X2). Then, the cord 202 extends downward. Hence, the cord 202 is curved in an arc shape surrounding the upper and rear sides of the user's external ear A.

As shown in FIG. 9, the speaker unit 210 is provided with a holding unit 213 that holds the cord 202. The holding unit 213 is formed in a clip-like manner. Specifically, the holding unit 213 has a fixed unit 213*b* extending downward and diagonally rearward from the edge of the housing 211; and a moving unit 213*c* extending downward and diagonally rearward along the fixed unit 213*b*. The moving unit 213*c* is supported such that a tip of the moving unit 213*c* and a tip of the fixed unit 213*b* can be opened and closed. In this example, a fulcrum unit 213*d* is disposed between the fixed unit 213*b* and the moving unit 213*c*, and the moving unit 213*c* is supported by the fulcrum unit 213*d*. The moving unit 213*c* is biased in a direction in which the tip of the moving unit 213*c* and the tip of the fixed unit 213*b* are closed, by a spring (not shown) disposed between the fixed unit 213*b* and the moving unit 213*c*, and the cord 2 is sandwiched between the fixed unit 213*b* and the moving unit 213*c*. In addition, the cord 202 slides relative to the holding unit 213 by the tip of the fixed unit 213*b* and the tip of the moving unit 213*c* opening.

Note that, as shown in FIG. 9, the fixed unit 213*b* and the moving unit 213*c* diagonally extend downward and in a speaker-directed direction (here, a right direction (a direction indicated by Y1)). Hence, the tip of the fixed unit 213*b* and the tip of the moving unit 213*c* hold the cord 2 in a position away in the speaker-directed direction from the housing 211. In addition, a cushion 213*e* is mounted on the fixed unit 213*b*. The cushion 213*e* prevents the fixed unit 213*b* from touching the user's ear or head when the earphone 200 is used.

Figure 10:
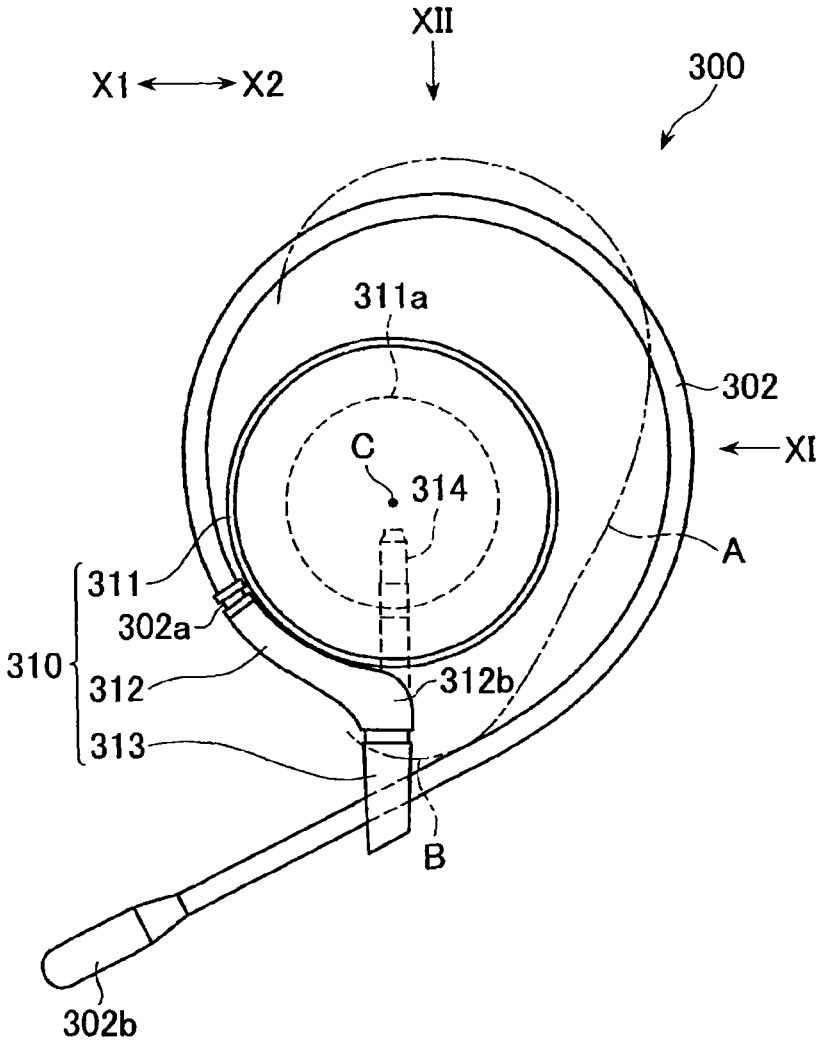
FIG. 10 is a side view of a headset according to an embodiment of the present invention.
Figure 11:
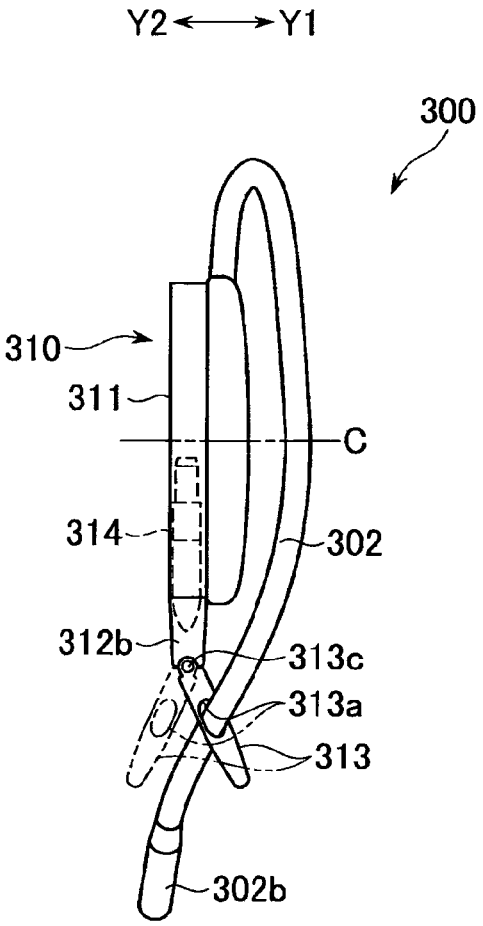
FIG. 11 is a view of the headset shown in FIG. 10 as viewed from arrow XI shown in FIG. 10.
Figure 12:
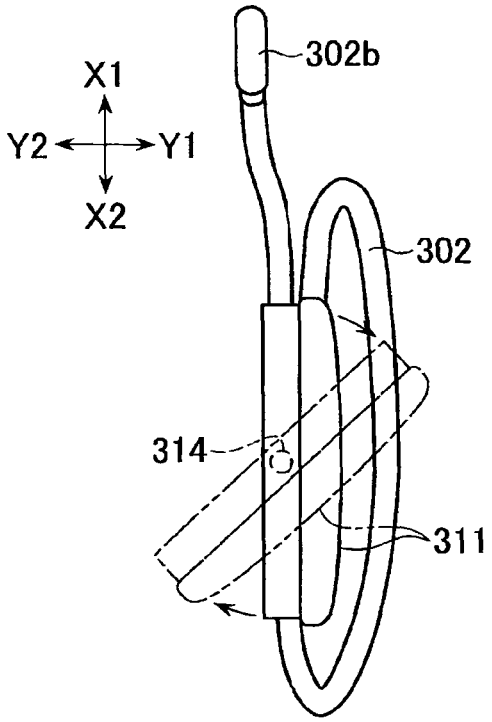
FIG. 12 is a view of the headset shown in FIG. 10 as viewed from arrow XII shown in FIG. 10.

In addition, the present invention may be applied to a headset having a speaker and a microphone. FIGS. 10 to 12 are diagrams showing a headset 300 according to an embodiment of the present invention. FIG. 10 is a side view of the headset 300. FIG. 11 is a view of the headset 300 as viewed from the direction of arrow XI shown in FIG. 10. FIG. 12 is a view of the headset 300 as viewed from the direction of arrow XII shown in FIG. 11.

As shown in FIG. 10, the headset 300 has: a speaker unit 310 including a speaker 311*a*; and a cord 302 connected to the speaker unit 310. The speaker unit 310 has a housing 311 substantially circular in side view, and the speaker 311*a* is accommodated in the housing 311. The speaker 311*a* in this example is also disposed so as to face the ear at the outer portion of the user's ear canal when the headset 300 is used.

The speaker unit 310 has a connecting unit 312 to which one end 302*a* of the cord 302 is connected. In this example, the connecting unit 312 extends frontward and diagonally upward from the lower side of the housing 311 along an edge of the housing 311. The one end 302*a* of the cord 302 is connected to a front end of the connecting unit 312 on the front side of the housing 311.

As shown in FIG. 10, the cord 302 is curved so as to be hooked over the user's external ear A. Specifically, the cord 302 extends upward from the one end 302*a* and then bends rearward and is curved in an arc shape surrounding the upper and rear sides of the user's external ear A. This curved portion is hooked over the user's external ear A when the headset 300 is used. The cord 302 extends frontward and diagonally downward in a position below the housing 311. A microphone 302*b* is provided at the other end of the cord 302.

As shown in FIG. 10, the speaker unit 310 is provided with a holding arm 313 that extends downward from a base 312*b* of the connecting unit 312 and holds the cord 302. The holding arm 313 holds the cord 302 in a position on the cord 302 away from the one end 302*a* of the cord 302, and the cord 302 is curved between a portion thereof held by the holding arm 313 and the one end 302*a*.

The holding arm 313 is configured such that the cord 302 can move relative to the holding arm 313. In this example, provided in the holding arm 313 is a hole 313*a* passing through the holding arm 313 in approximately front and rear directions (see FIG. 11). The cord 302 extends frontward and diagonally downward, passing through the hole 313*a* and is slidable in the front and rear directions relative to the holding arm 313. The cord 302 also has flexibility and thus when the user pulls the cord 302 frontward, the cord 302 slides frontward relative to the holding arm 313. As a result, the length of the curved portion of the cord 302 is shortened. As a result, the size of the curved portion of the cord 302 becomes one that fits the user's external ear A and thus the cord 302 is securely hooked over the user's external ear A.

As shown in FIG. 10 or 12, in the headset 300, the housing 311 is rotatable relative to the connecting unit 312 and the holding arm 313 so that the speaker 311*a* can face in two directions opposite to each other. In this example, the connecting unit 312 is provided with a plug (supporting unit) 314 that electrically connects the cord 302 to the speaker 311*a*, and the housing 311 is rotatably supported by the plug 314. Specifically, the plug 314 projects upward from the base 312*b* of the connecting unit 312 located below the housing 311 toward a center C of the housing 311, and is inserted into the housing 311. The plug 314 is formed in a cylindrical shape. Hence, the housing 311 is rotatable about the plug 314. Then, the housing 311 rotates between a position in which the speaker 311*a* faces in a right direction (a direction indicated by Y1 in FIG. 12) (a position of the housing 311 indicated by a solid line in FIG. 12) and a position in which the speaker 311*a* faces in a left direction (a direction indicated by Y2 in FIG. 12). Therefore, the headset 300 can be placed on both the user's right and left ears.

As shown in FIG. 11, the holding arm 313 extends downward from the base 312*b* of the connecting unit 312 and is inclined in a speaker-directed direction (a right direction in FIG. 11). Hence, the position of the hole 313*a* provided in the holding arm 313 is shifted in the speaker-directed direction from the position of the plug 314 in the left and right directions. That is, the holding arm 313 holds the cord 302 in a position away in the speaker-directed direction (here, the right direction) from the position of the plug 314.

As described above, the housing 311 is rotatably supported. Accordingly, the holding arm 313 is also configured to be movable. Specifically, as shown in FIG. 11, the holding arm 313 is movable between a first position in which the cord 302 is held in a position shifted in the right direction from the position of the plug 314 in the left and right directions (the position of the holding arm 313 indicated by a solid line in FIG. 11) and a second position in which the cord 302 is held in a position shifted in the left direction from the position of the plug 314 (the position of the holding arm 313 indicated by a dash-double-dotted line in FIG. 11). In this example, the holding arm 313 is configured such that the inclination direction thereof is changed in the right or left direction. Specifically, a base of the holding arm 313 is coupled to the connecting unit 312 via a shaft 313*c* disposed to extend in the front and rear directions. Hence, the holding arm 313 moves around the shaft 313*c* in the right or left direction.

Therefore, even when the headset 300 is placed on either of the user's ears, the position of the curved portion of the cord 302 can be brought close to the user's head, enabling to stably hook the cord 302 over the user's external ear A. In addition, even when the headset 300 is placed on either of the user's ears, a clearance is secured between the curved portion of the cord 302 and the base 312*b* of the connecting unit 312, and thus, the user's earlobe B can be located in the clearance.

Note that, in the headset 300, the speaker unit 310 is configured such that the orientation of the speaker 311*a* can face in both the right and left directions. Accordingly, the holding arm 313 is also movably provided. However, the headset does not need to be provided with such a mechanism.

Figure 13:
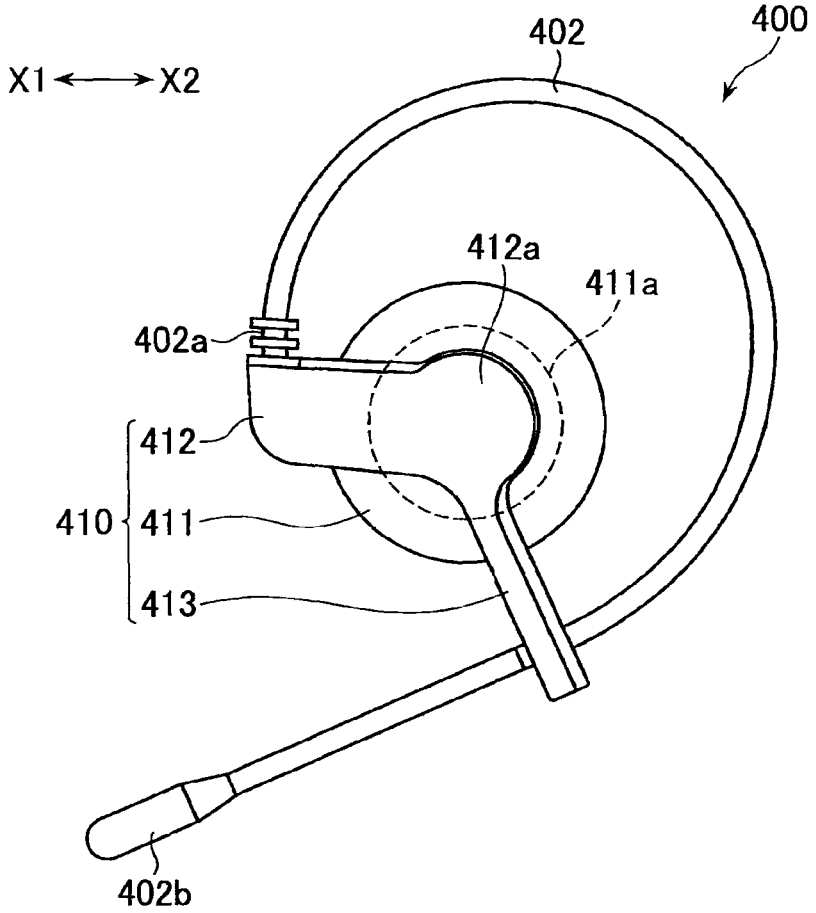
FIG. 13 is a side view of a headset according to another embodiment of the present invention.

For example, in a headset 400 shown in FIG. 13, a speaker unit 410 has: a housing 411 that accommodates a speaker 411*a*; a connecting unit 412 provided so as to extend frontward; and a holding arm 413 extending downward from a base 412*a* of the connecting unit 412. The base 412*a* of the connecting unit 412 is mounted on a side of the housing 411 and the orientation of the speaker 411*a* relative to the connecting unit 412 is fixed. Note that in the headset 400, too, one end 402*a* of a cord 402 is connected to a front end of the connecting unit 412 on the front side of the housing 411. The cord 402 extends upward from the one end 402*a* and then is curved rearward so as to be hooked over the user's external ear A. The cord 402 extends frontward and diagonally downward in a position below the housing 411, and a microphone 402*b* is provided at the other end of the cord 402. The holding arm 313 extends downward from the base 412*a* of the connecting unit 412 and holds the cord 402 in a position below the housing 411.

The invention claimed is:

1. A portable audio output device to be placed on a user's ear, the device comprising:

a speaker unit comprising a speaker; and a cord having one end connected to the speaker unit, wherein the cord is curved so as to be hooked over a user's external ear, wherein the speaker unit has a holding unit, wherein a portion of the cord is slidably engaged with the holding unit, the holding unit holding the cord at a position on the cord away from the one end of the cord such that the cord is curved between the one end and the portion thereof being slidably engaged with the holding unit, wherein the holding unit is configured such that the cord can move relative to the holding unit, and wherein a length of the cord between the one end and the holding unit is adjustable, and wherein the speaker unit has a housing that accommodates the speaker, wherein the housing is provided such that the speaker can face in two directions opposite to each other, and the holding unit diagonally extends from the housing in a radial direction of the speaker and in one of the two directions in which the speaker faces, and wherein the speaker unit has a supporting unit that rotatably supports the housing.

2. The portable audio output device according to claim 1, wherein the cord is curved so as to be hooked over the user's external ear and then extends downward, and the holding unit holds the portion of the cord extending downward.

3. The portable audio output device according to claim 1, wherein the holding unit comprises a pair of projections defining a hole and the cord passes through the hole in the holding unit.

4. The portable audio output device according to claim 1, wherein the holding unit extends from a lower end of the housing and holds the portion of the cord by an end thereof.

5. The portable audio output device according to claim 1, wherein the speaker unit has a connecting unit formed so as to extend from the housing, and the one end of the cord is connected to an upper end of the connecting unit.

6. The portable audio output device according to claim 5, wherein the connecting unit extends from the housing and is curved in an extending direction on a side of the one end of the cord.

7. The portable audio output device according to claim 1, wherein the speaker unit has a connecting unit to which the one end of the cord is connected, the connecting unit being located before the speaker, the cord extends upward from the connecting unit and then is curved downward, and the holding unit holds the cord in a position below the speaker.

8. The portable audio output device according to claim 1, wherein the speaker unit has a connecting unit to which the one end of the cord is connected, and the connecting unit is formed of an elastic material.

9. The portable audio output device according to claim 1, wherein the holding unit is formed of an elastic material.

10. The portable audio output device according to claim 1, wherein the speaker unit has a supporting unit that supports the housing, and the holding unit is movable between a first position in which the cord is held in a position shifted in one of the two directions from a position of the supporting unit and a second position in which the cord is held in a position shifted in another direction from the position of the supporting unit.

11. The portable audio output device according to claim 1, wherein the holding unit comprises a clip-like structure configured to hold the portion of the cord.

12. The portable audio output device according to claim 11, wherein a position of the clip-like structure is adjusted in accordance with the length of the cord between the one end and the holding unit.

13. The portable audio output device according to claim 1, wherein the speaker unit has an upper end, and wherein the one end of the cord is connected to the upper end of the speaker unit.

14. A portable audio output device to be placed on a user's ear, the device comprising:

a speaker unit comprising a speaker; and a cord having one end connected to the speaker unit, wherein the cord is curved so as to be hooked over a user's external ear, wherein the speaker unit has a holding unit, wherein a portion of the cord is slidably engaged with the holding unit, the holding unit holding the cord at a position on the cord away from the one end of the cord such that the cord is curved between the one end and the portion thereof being slidably engaged with the holding unit, wherein the holding unit is configured such that the cord can move relative to the holding unit, and wherein a length of the cord between the one end and the holding unit is adjustable, and wherein the speaker unit has a connecting unit formed so as to extend from a housing that accommodates the speaker, and the one end of the cord is connected to an upper end of the connecting unit, wherein the housing is rotatable relative to the connecting unit and the holding unit.

15. A portable audio output device to be placed on a user's ear, the device comprising:

a speaker unit comprising a speaker; and a cord having one end connected to the speaker unit, wherein the cord is curved so as to be hooked over a user's external ear, wherein the speaker unit has a holding unit, the holding unit holding the cord at a position on the cord away from the one end of the cord such that the cord is curved between the one end and a portion thereof held by the holding unit, wherein the holding unit is configured such that the cord can move relative to the holding unit, wherein the speaker unit has a housing that accommodates the speaker, and the housing is provided such that the speaker can face in two directions opposite to each other, wherein the holding unit diagonally extends from the housing in a radial direction of the speaker and in one of the two directions in which the speaker faces, and wherein the speaker unit has a supporting unit that rotatably supports the housing.

* * * * *